United States Patent [19]

van Herpen

[11] Patent Number: 4,909,483

[45] Date of Patent: Mar. 20, 1990

[54] SUPPORT FOR THE HANDRAIL OF A DETACHABLE HANDRAIL UNIT

[75] Inventor: Frederik C. van Herpen, Burgh-Haamstede, Netherlands

[73] Assignee: Alprokon Promotie en Dontwikkeling B.V., Netherlands

[21] Appl. No.: 185,127

[22] Filed: Apr. 22, 1988

[30] Foreign Application Priority Data

Apr. 24, 1987 [NL] Netherlands ..... 8700981

[51] Int. Cl.[4] ..... E04H 17/14

[52] U.S. Cl. ..... 256/59; 256/65; 256/DIG. 6; 182/113

[58] Field of Search ..... 256/67, 64, 65, 59, 256/12.5, DIG. 6, DIG. 2, 26; 182/113

[56] References Cited

U.S. PATENT DOCUMENTS

| | | | |
|---|---|---|---|
| 565,966 | 8/1896 | Deck | 256/DIG. 2 X |
| 3,010,684 | 11/1961 | Phillips et al. | 256/12.5 X |
| 3,630,491 | 12/1971 | Puccio | 256/64 |
| 3,747,898 | 7/1973 | Warren | 256/59 |
| 3,847,489 | 11/1974 | Van Riper | 256/65 X |
| 3,867,997 | 2/1975 | Hyslop, Jr. | 256/65 X |
| 3,880,405 | 4/1975 | Brueske | 182/113 X |
| 3,901,481 | 8/1975 | Probst | 182/113 X |
| 3,924,834 | 12/1975 | Young | 256/59 X |
| 3,995,834 | 12/1976 | Melfi | 256/59 |
| 4,635,905 | 1/1987 | Fontana | 256/59 X |
| 4,666,131 | 5/1987 | Kettelkamp, Sr. et al. | 256/DIG. 6 X |

FOREIGN PATENT DOCUMENTS

| | | | |
|---|---|---|---|
| 2807432 | 10/1978 | Fed. Rep. of Germany | 256/12.5 |
| 8614596.7 | 8/1986 | Fed. Rep. of Germany . | |
| 1280836 | 4/1963 | France . | |
| 2229834 | 12/1974 | France . | |
| 2448604 | 9/1980 | France . | |

*Primary Examiner*—Randolph A. Reese
*Assistant Examiner*—Peter M. Cuomo
*Attorney, Agent, or Firm*—Ostrolenk, Faber, Gerb & Soffen

[57] ABSTRACT

Support for the handrail of a detachable handrail assembly, with a base kept in place by weight and a post which is connected thereto and to which the handrail can be fixed, in which the bottom end of the post lies a distance above the bearing face of the base, base and post are interconnected by a horizontal hinge situated at a distance above the bearing face, and structure is provided for locking the base and post relative to each other when in the folded-out position.

12 Claims, 6 Drawing Sheets

SUPPORT FOR THE HANDRAIL OF A DETACHABLE HANDRAIL UNIT

BACKGROUND OF THE INVENTION

The invention relates to a support for the handrail of a detachable handrail assembly, in particular for protecting an open roof comprising a base kept in place by a weight and a post which is connected thereto and to which the handrail can be fixed.

DESCRIPTION OF THE PRIOR ART

Such a support and the handrail assembly provided therewith are known in practice and described in a brochure of this firm marketed by Robo Safety Products Ltd., Thornsett Works, London.

Although the use of this known assembly already means a considerable improvement over the old situation in which when work—such as renewing the roof covering—is being carried out on a roof no safety handrail at all is used, this known system still has disadvantages and shortcomings which could in practice lead to its not being used, when compulsory regulations fail. When the assembly is used, its presence on the edge of the roof is found to be a nuisance, since it makes the carrying out of work on that edge more difficult. This is because in the known unit the base is provided at one end with an upright socket into which the post is pushed and then secured with a locking screw, while the base itself is made up of two parts, a first, flat, socket-bearing part having at the end facing away from the socket a flat insert opening for the end of a second part extending from a housing intended to take the weight.

The temporary removal of parts of the system, which is necessary when work such as renewal of the roof covering has to be carried out on the edge of the roof, is consequently laborious and time-consuming. It is then necessary first to detach the second base part from the first base part and to remove it, and the locking screw must then be loosened to release the socket from the post, following which the socket with the first base part fixed thereto must be slid upwards along the post now hanging on the handrail. Only then is the space underneath the first base part accessible. Erecting and dismantling the unit made up of many parts is also laborious and time-consuming.

SUMMARY OF THE INVENTION

The object of the invention is to eliminate these shortcomings, and this object is achieved in that the bottom end of the post lies a distance above the bearing face of the base, base and post are interconnected by means of a horizontal hinge situated at a distance above said bearing face, and means are provided for locking the base and post relative to each other when in the folded-out position.

The folding up of the base after removal of the weight means that the space underneath the base and the post is instantly free from obstacles, so that work can be carried out there unimpeded. When the base is folded up towards the post, the post remains hanging on the rail, of course still connected to the adjacent posts.

In a preferred embodiment the hinge is connected to the free end of the first leg of a corner piece, the second leg of which is connected to the base. This gives the possibility, with a design which is very simple, to increase the free space produced underneath the post when the base is folded up, since said space is determined by the length of the first leg of the corner piece.

Preferably the base is interconnected by means of a first hinge near the free end thereof to the one end of at least one hinge arm of which the other end is connected through a second hinge, parallel to the first one, to the lower end of the post. There can also be two mutually parallel hinge arms, enclosing with their respective ends the base and the post respectively.

These measures result in the advantage of an increased free space under the post which can thus be placed directly above the, higher, roof edge while furthermore the roofing material at that place is optimally accessible.

In a preferred embodiment base and post are interconnected by at least one hinge arm system with toggle joint.

The post preferably bears at least one handrail carrier which is open at the top and is provided with a securing element. This makes it possible to set up the corner connection between the handrail parts in a simple manner, so that it is not necessary to use separate corner connecting pieces.

DESCRIPTION OF PREFERRED EMBODIMENTS

Figure 1:
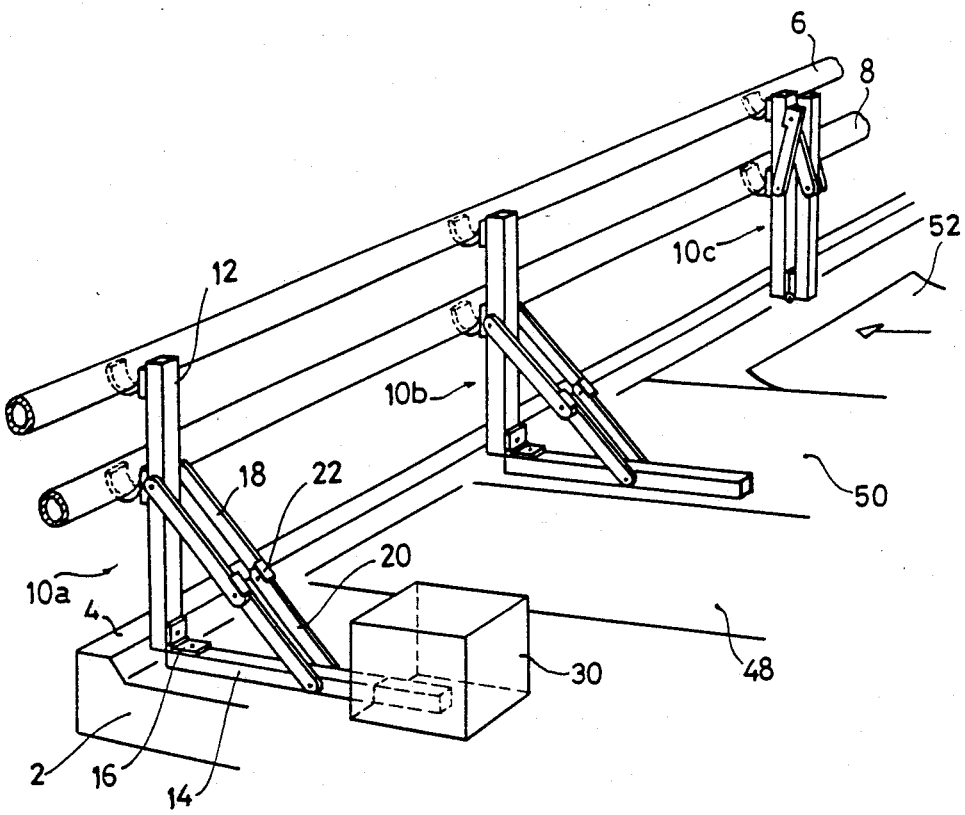
FIG. 1 is a perspective drawing of part of a safety handrail assembly made up of supports according to the invention, and fitted on the edge of a roof.

In FIG. 1 the reference number 2 indicates part of a roof with the end edge 4. In order to ensure the safety of persons having to carry out work such as renovation or repair of the roof covering on this roof, a handrail assembly is fitted at the roof edge 4, said handrail assembly being made up of the handrails 6, 8, support by a number of handrail supports which are positioned at intervals along the roof edge 4, and three of which are shown in FIG. 1 by reference numbers 10*a*, 10*b*, 10*c*. Each handrail support consists of a post 12 and a base 14, connected to each other by means of a hinge 16; a double hinge arm system is fitted between post 12 and base 14 and has the hinge arms 18 and 20, which are connected to each other by means of a horizontal hinge 22. Each arm 18 is connected by means of a hinge 24 to the post 12, and each arm 20 is connected by means of a hinge 26 to the base 14. Buckling is prevented in the manner known for hinge arms by a stop 28, and the whole unit is kept stable by the arms being forced slightly through the dead center, as known per se for hinge arms.

Each base 14 is held in place by a weight 30, only one of which, for the sake of clarity, is shown in FIG. 1.

The handrails 6 and 8 rest in handrail carrier 32, 34 respectively, and after placing therein are held in place by spring-loaded retaining pins 36, 38 respectively.

The front face of the post 12 has formed in it a guide groove 40, into which fit suitable sliding pieces 42 which are connected to the respective handrail carrier and which can be fixed by means of tensioning bolts 44, so that each handrail carrier can be fixed at a desired height.

Figure 2:
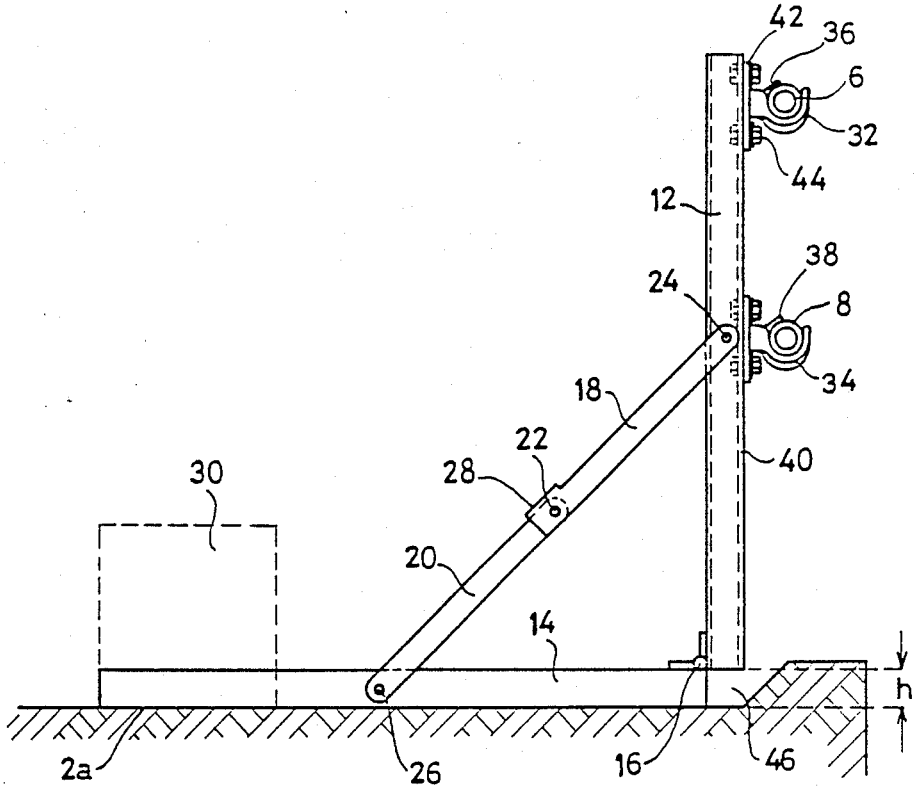
FIG. 2 is a side view of the combinations of base and post according to the invention, opened out.
Figure 3:
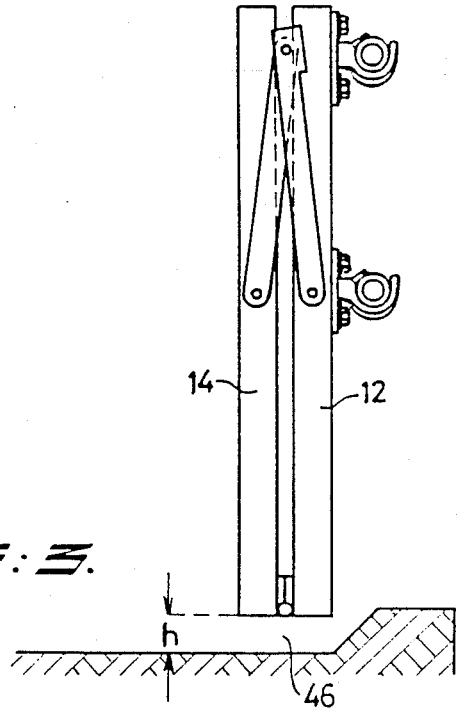
FIG. 3 is a side view of said support, folded up.
Figure 4:
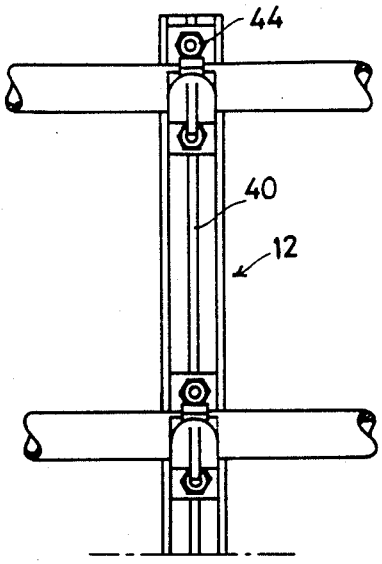
FIG. 4 is a front view of the post used in the support according to the invention.

As can be seen in detail in FIGS. 2 and 3, the hinge point 16 is at certain distance, indicated by h, above the surface 2*a* of the roof 2. The result of this is that when a handrail support is folded up—which is possible without further ado on removal of the weight 30 and folding up of the base 14 to the post 12—see FIG. 2—there is a free space with a height h underneath the handrail support. This means that the edge zone of the roof 2 is directly accessible near the edge 4, so that work such as fitting new roofing, which has to be carried out in this edge zone, is possible without problems and loss of time resulting from the time-consuming dismantling of handrail supports. When the base 14 is folded up, the handrail support remains in place, due to the fact that the post 12 remains hanging on the handrails 6, 8 by means of the retaining pins 36 and 38 respectively.

FIG. 1 shows schematically how already two lengths of roofing material, indicated by 48 and 50, are fitted on the roof 2; the handrail support 10*c* is folded up and the length of roofing material which is indicated by the reference number 52 can be taken without further ado close to the roof edge 4.

The unit described has not only the advantage that a free space can be created particularly quickly underneath the respective handrail supports for the purpose of carrying out the desired work, but also that the fitting and removal takes place particularly quickly. There are no loose parts which have to be inserted into each other and tightened relative to each other: the handrail supports are put in the desired place, opened out and loaded with a weight; when a number of handrail supports have been placed, the handrail parts 6 and 8 can be fitted.

In the embodiment according to FIGS. 1 to 4 the height h of the free space 46 which can be created underneath the post 12 is determined by the height of the base part 14.

Figure 5:
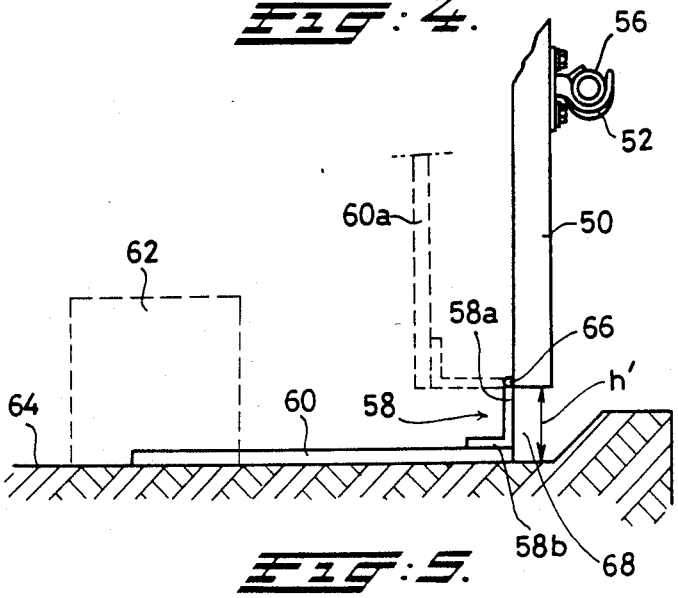
FIG. 5 is a schematic view of a modified embodiment according to the invention.

FIG. 5 shows an embodiment in which this free space is greater than the height of the base part, which can be advantageous either when one wishes to create a higher free space using a base part with the configuration shown in FIGS. 1 to 4, or when a flat base part is to be used.

As FIG. 5 shows, in the said embodiment the post 50 bearing the handrail part 56 via the carrier 52 is connected by means of a corner piece 58 to the, here flat, base part 60, which, loaded by the weight 62, rests on the top face 64 of the roof; the corner piece 58 is connected by means of the horizontal hinge 66 to the post 50. As can be seen from the figure, the height of the free space 68 obtained underneath the handrail support when the base 60 is folded up to the position 60*a* shown by dotted lines is considerably greater; the height h being determined by the height of the leg 58*a* of the corner piece 58.

According to the state of the art, when constructing a handrail assembly, separate corner pieces are used for joining together the handrail parts at the corners. In a preferred embodiment according to the invention, which hardly increases the cost of the handrail unit, the use of such connecting pieces is not necessary. This embodiment is shown in FIG. 6.

Figure 6:
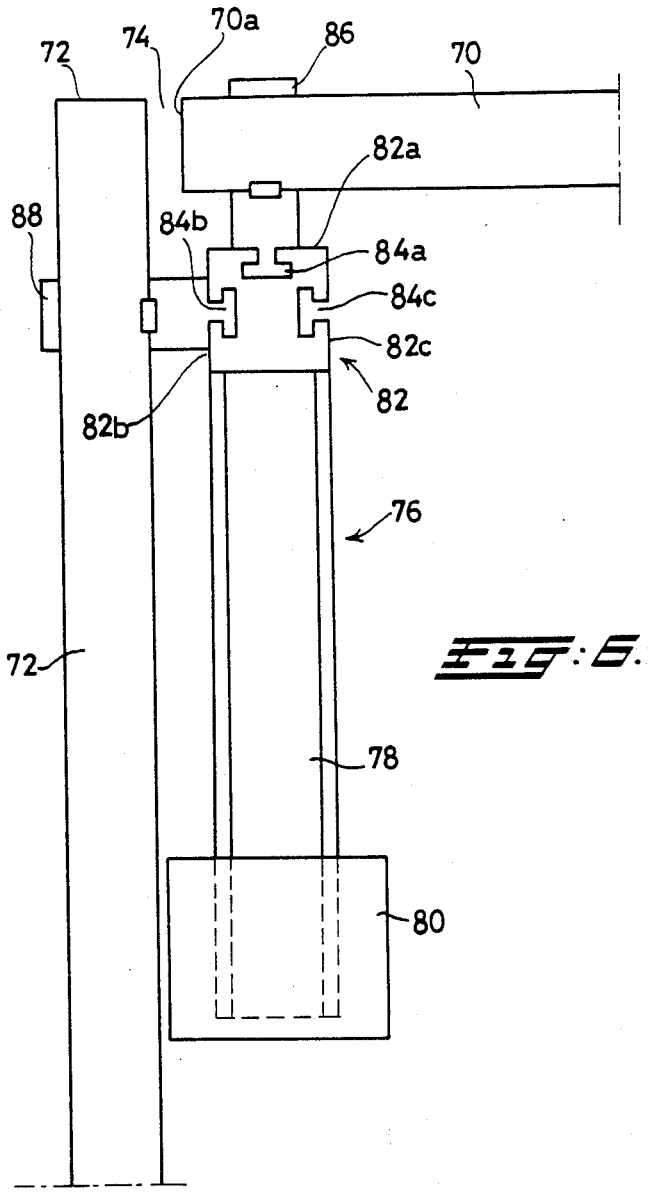
FIG. 6 shows schematically a handrail corner connection formed with a special embodiment of the support according to the invention.
Figure 7:
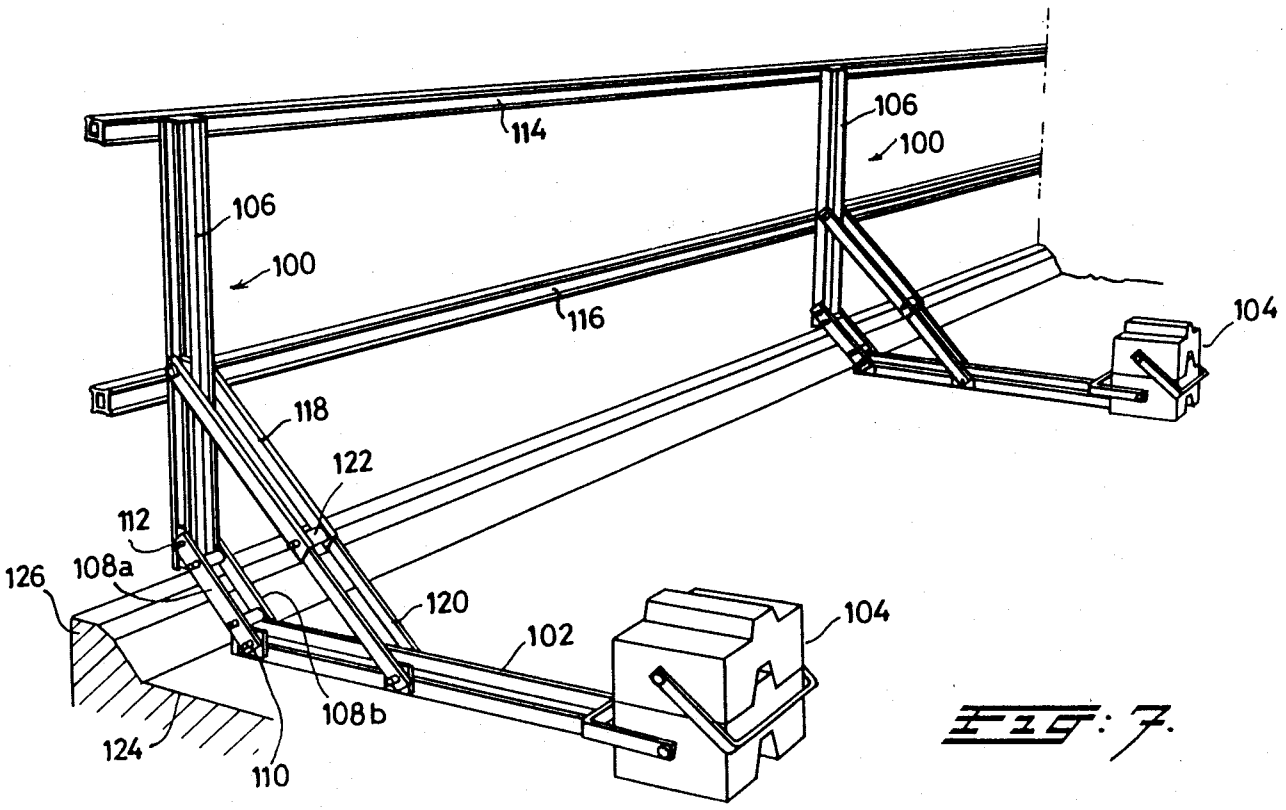
FIG. 7 is a perspective view of another embodiment according to the invention.
Figure 8:
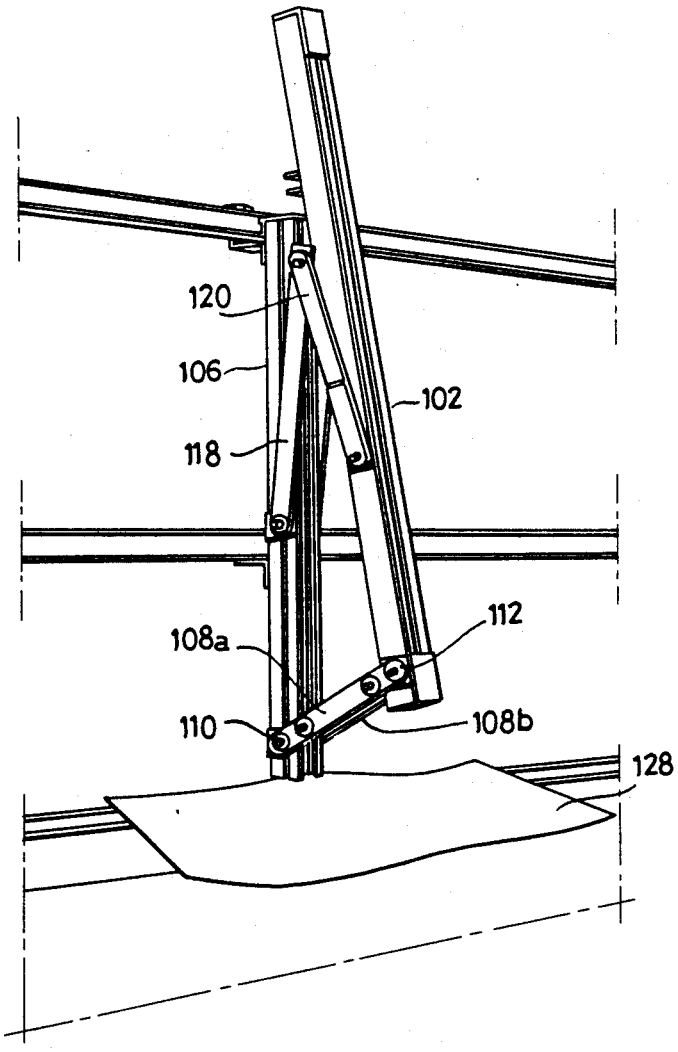
FIG. 8 is an illustration of a support of the embodiment of FIG. 7, in a folded state.

FIG. 6 shows the two handrail parts 70 and 72, the ends 70*a*, 72*a* of which lie close to each other at the corner 74. Not only is the post 82 of the support 76 with base 78, loaded by the weight 80, provided on its front face 82*a* with a guide groove 84 for the handrail carrier 86, in the manner already described above but the side faces 82*b* and 82*c* are also provided with such a guide groove, indicated by 84*b* and 84*c* respectively. The guide groove 84*b* contains the handrail carrier 88 bearing the handrail part 72. The handrail carriers are fixed in the manner described above with reference to FIG. 2 by means of sliding pieces and tensioning bolts which, for the sake of clarity, are not shown. In this way the handrail parts 70 and 72 are joined together at the corner 74 without extra parts.

I claim:

1. A support assembly for a handrail of a handrail assembly, comprising:

a handrail extending horizontally, the support assembly for the handrail comprising:

a base having a bottom for resting on a surface on which the support assembly supports the handrail, the base also having an end facing in a direction across that of the bottom;

an upright post extending to and attached to the handrail, the post having a front side, and the base end generally being behind the front side of the post so that the end of the base does not extend past the post, the post having a bottom end;

a hinge connecting the base to pivot with respect to the post, the hinge having a pivot located above the bottom of the base and generally at the end of the base and being generally at the bottom end of the post, for enabling the base to pivot between a generally upright position up toward the upright post and a folded-out position with the bottom of the base on the surface;

whereby with the base being folded upright from the folded-out position toward the post about the hinge, a free space is defined beneath both of the bottom end of the post and the end of the base without moving the post up.

2. The support assembly of claim 1, further comprising a weight for holding the base to the surface.

3. The support assembly of claim 2, wherein the weight is readily removable from the base.

4. The support assembly of claim 1, further comprising means for locking the base and post relative to each other in a folded-out position.

5. The support assembly of claim 1, wherein the hinge is a horizontal hinge.

6. The support assembly of claim 1, further comprising a plurality of the posts spaced along the handrail and a respective one of the bases for each of the posts; each base having an independent hinge connecting the base to its respective post.

7. Support according to claim 1, in which the post comprises a guide groove, running in the lengthwise direction of the post and open to the front, for a handrail clip which can be fixed at an adjustable height.

8. Support according to claim 1, in which at at least one of the side faces the post comprises a guide groove, running in the lengthwise direction of the post and open at the front, for a handrail carrier which can be fixed at an adjustable height.

9. The support assembly of claim 1, further comprising a second hinge on the base and spaced from the first mentioned hinge, a third hinge on the post also spaced from the first mentioned hinge, and at least one hinge arm between the second and the third hinges for further hingedly interconnecting the base and the post.

10. The support assembly of claim 9, wherein the hinge arm is a toggle arm, which is a collapsible in its structure between the second and third hinges for permitting the base to be pivoted around the first mentioned hinge with respect to the post.

11. The support assembly of claim 1, further comprising a hinge arm joining the base and the post, the hinge arm having a toggle joint therein for permitting the base to pivot around the first mentioned hinge with respect to the post.

12. The support assembly of claim 1, further comprising a handrail carrier disposed on the post, the carrier being open at the top for receiving the post therein and a securing element being disposed on the handrail carrier.

* * * * *